US012773646B2

(12) United States Patent
Johnson et al.

(10) Patent No.: US 12,773,646 B2
(45) **Date of Patent: *Oct. 27, 2026**

(54) VERSATILE THREE-DIMENSIONAL FORT BUILDING KIT

(71) Applicant: Make-A-Fort, LLC, Augusta, KS (US)

(72) Inventors: Kent Johnson, Augusta, KS (US); Troy Lindemann, Wichita, KS (US)

(73) Assignee: Make-A-Fort, LLC, Augusta, KS (US)

( * ) Notice: Subject to any disclaimer, the term of this patent is extended or adjusted under 35 U.S.C. 154(b) by 207 days.

This patent is subject to a terminal disclaimer.

(21) Appl. No.: 18/739,021

(22) Filed: Jun. 10, 2024

(65) Prior Publication Data

US 2026/0034473 A1 Feb. 5, 2026

Related U.S. Application Data

(63) Continuation-in-part of application No. 17/550,643, filed on Dec. 14, 2021, now Pat. No. 12,029,997, (Continued)

(51) Int. Cl.

| | |
|---|---|
| ***A63H 33/04*** | (2006.01) |
| ***A63H 33/00*** | (2006.01) |
| ***A63H 33/10*** | (2006.01) |

(52) U.S. Cl.

CPC ..... *A63H 33/044* (2013.01); *A63H 33/008* (2013.01); *A63H 33/102* (2013.01); *A63H 33/105* (2013.01)

(58) Field of Classification Search

CPC ..... A63H 33/04; A63H 33/10; A63H 33/102

See application file for complete search history.

(56) References Cited

U.S. PATENT DOCUMENTS

| | | | |
|---|---|---|---|
| 38,557 | A | 5/1863 | Budd |
| 1,867,374 | A | 7/1932 | Myers |

(Continued)

FOREIGN PATENT DOCUMENTS

| | | |
|---|---|---|
| GB | 2530540 | 3/2016 |
| JP | 2005218481 A | 8/2005 |

OTHER PUBLICATIONS

MomsManufactureStore, Princess castle playhouse, Retrieved from Etsy, Retrieved on Apr. 2, 2019 <URL: https://www.etsy.com/listing/675698823/princess-castle-playhouse-cardboard?>.

(Continued)

*Primary Examiner* — Nicholas J. Weiss

(57) ABSTRACT

A 3D fort building kit is a device that can create a variety of structures and shapes. In other words, the device has improved materials and designs with better qualities, that enables kids to build complex 3D structures. To accomplish this, the device includes panels, connectors and utility features that help kids to construct and assemble a structure of their choice in many designs. Further, structures may be constructed in many creative designs by allowing the panels to be connected vertically, horizontally, and at any angle. Furthermore, the constructed structures can be disassembled and constructed again to build other designs safely by kids. Additionally, the device is simple, durable, and light weight enough for young kids to build stable and versatile structures of their choice.

13 Claims, 12 Drawing Sheets

Related U.S. Application Data which is a continuation-in-part of application No. 29/762,037, filed on Dec. 14, 2020, now abandoned.

(60) Provisional application No. 63/125,168, filed on Dec. 14, 2020.

(56) References Cited

U.S. PATENT DOCUMENTS

| | | | | |
|---|---|---|---|---|
| 3,264,021 | A | 8/1966 | Artman | |
| 3,827,177 | A | 8/1974 | Wengel | |
| D235,571 | S | 6/1975 | Jaros | |
| 4,454,678 | A | 6/1984 | Duvivier | |
| 4,635,411 | A | 1/1987 | Kurzen | |
| D308,705 | S | 6/1990 | Olsen | |
| D326,688 | S | 6/1992 | Maurer | |
| 5,121,526 | A | 6/1992 | Burkard | |
| 5,281,185 | A | 1/1994 | Lee | |
| 5,372,450 | A | 12/1994 | Blodgett | |
| D370,945 | S | 6/1996 | Bertrand | |
| 5,662,508 | A | 9/1997 | Smith | |
| D384,996 | S | 10/1997 | Munir | |
| D400,604 | S | 11/1998 | Glickman | |
| D404,090 | S | 1/1999 | Glickman | |
| 6,443,798 | B1 | 9/2002 | Perry | |
| 7,104,864 | B1 | 9/2006 | Liou | |
| 8,753,162 | B2 | 6/2014 | Jensen | |
| D714,400 | S | 9/2014 | Jensen | |
| 9,238,180 | B2 | 1/2016 | Kennedy | |
| 9,724,618 | B2 | 8/2017 | Shalom | |
| D832,933 | S | 11/2018 | Maksimov | |
| 10,518,192 | B1 * | 12/2019 | Swan | A63H 33/008 |
| 12,029,997 | B2 * | 7/2024 | Johnson | A63H 33/008 |
| 2005/0014441 | A1 | 1/2005 | Matos | |
| 2005/0073094 | A1 | 4/2005 | Antos | |
| 2005/0108955 | A1 | 5/2005 | Howe | |
| 2006/0135033 | A1 | 6/2006 | Evans | |
| 2007/0004312 | A1 | 1/2007 | Jeske | |
| 2014/0235133 | A1 | 8/2014 | Ksobiech | |
| 2017/0197153 | A1 | 7/2017 | Styles | |
| 2018/0214786 | A1 | 8/2018 | Crouse | |
| 2018/0229141 | A1 | 8/2018 | Miller | |
| 2019/0344191 | A1 | 11/2019 | Nawracala | |

OTHER PUBLICATIONS

Boxly, The Cardboard Fort-Building Kit, Retrieved from Kickstarter, Retrieved on Apr. 2, 2019 <URL: https://www.kickstarter.com/projects/boxlyinc/boxly-the-cardboard-fort-building-kit>.

HearthSong Store, 6-Panel Igloo Fantasy Forts Indoor Building Kit, Retrieved from Amazon, Retrieved on Apr. 2, 2019 <URL: https://www.amazon.com/HearthSong%C2%AE-Igloo-Fantasy-Fort-Approx/dp/B07JJLFJ97>.

Build the Mansion Fort X1, Retrieved from Internet, Retrieved on Apr. 10, 2021: <URL:https://www.makeafort.fun/build-a-fort> (Year: 2019).

Fort Boards—Fort Building Kit, Reviewed and online as early as Dec. 27, 2016 [online], [site visited Apr. 10, 2021]. Available from Internet:<URL:https://www.amazon.com/Fort-Boards-Building-Jumbo-Blocks/dp/B01 M4J FG5I/> (Year: 2016).

* cited by examiner

VERSATILE THREE-DIMENSIONAL FORT BUILDING KIT

The current application is a continuation application of the U.S. non-provisional application Ser. No. 17/550,643 filed on Dec. 14, 2021. The U.S. non-provisional application Ser. No. 17/550,643 is a continuation-in-part (CIP) application of the U.S. design application Ser. No. 29/762,037 filed on Dec. 14, 2020. The U.S. non-provisional application Ser. No. 17/550,643 also claims a priority to the U.S. provisional patent application Ser. No. 63/125,168 filed on Dec. 14, 2020.

FIELD OF THE INVENTION

The present invention relates generally to building kits. More specifically, the present invention provides a kit for kids to create arbitrary complex 3D (i.e., three-dimensional) forts.

BACKGROUND OF THE INVENTION

Building toys engages kids in imaginative real-world play, and thus is an effective way to get kids away from smartphones, tablets, and video games. Further, building toys also help children develop essential skills while playing. More importantly, playing with fort building kits enhances kid's engineering skills, creativity, imagination, and spatial reasoning. Generally, a fort building kit in the industry comes with several square shaped boards and connectors for kids to build forts. However, a building kit that allows children to build forts, castles, tunnels, nerf forts, mazes, etc. of various sizes and shapes is a rare find in the current market.

An objective of the present invention is to provide a uniquely designed building kit that can create a variety of structures and shapes. In other words, it is an aim of the present invention to provide a building kit that has improved materials and designs for better qualities, that enables kids to build complex 3D structures. To accomplish this, the present invention comprises panels, and connectors that helps the kids to construct and assemble a structure of their choice in many designs. More specifically, structures may be constructed in many creative designs by allowing the panels to be connected vertically, horizontally, and at any angle. Further, the constructed structures can be disassembled and constructed again to build other designs. To that end, the present invention can be disassembled safely by kids to prevent trapping kids in the structure. Additionally, the present invention is simple, durable, and light weight enough for young kids to build different structures of their choice.

DETAILED DESCRIPTION OF THE INVENTION

Figure 1:
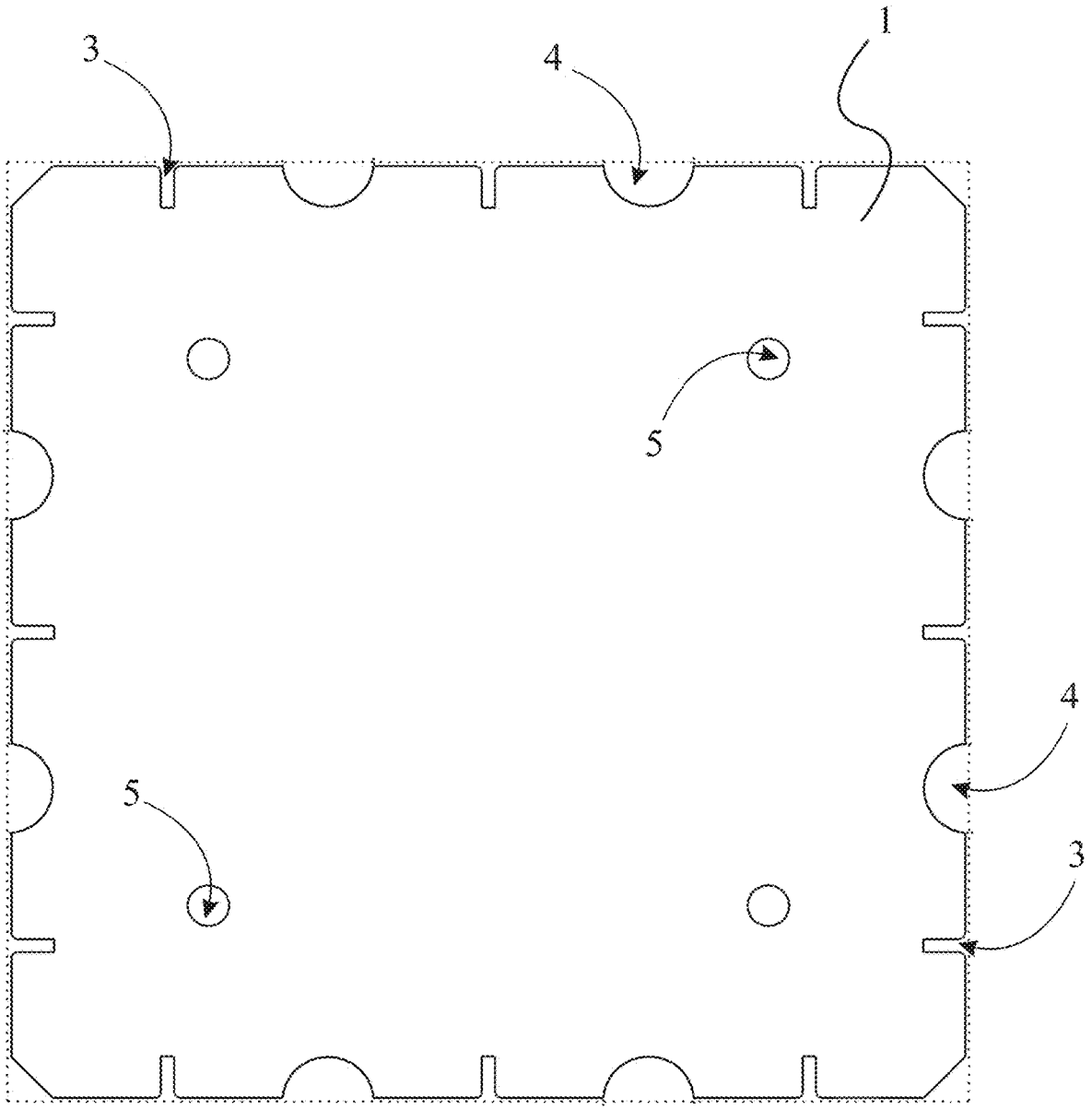
FIG. 1 is a front elevational view of a panel according to a preferred embodiment of the present invention.
Figure 2:
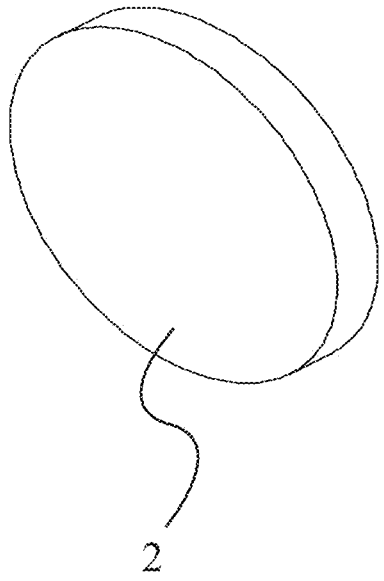
FIG. 2 is a top-front-left perspective view of a connector, according to the present invention.
Figure 3:
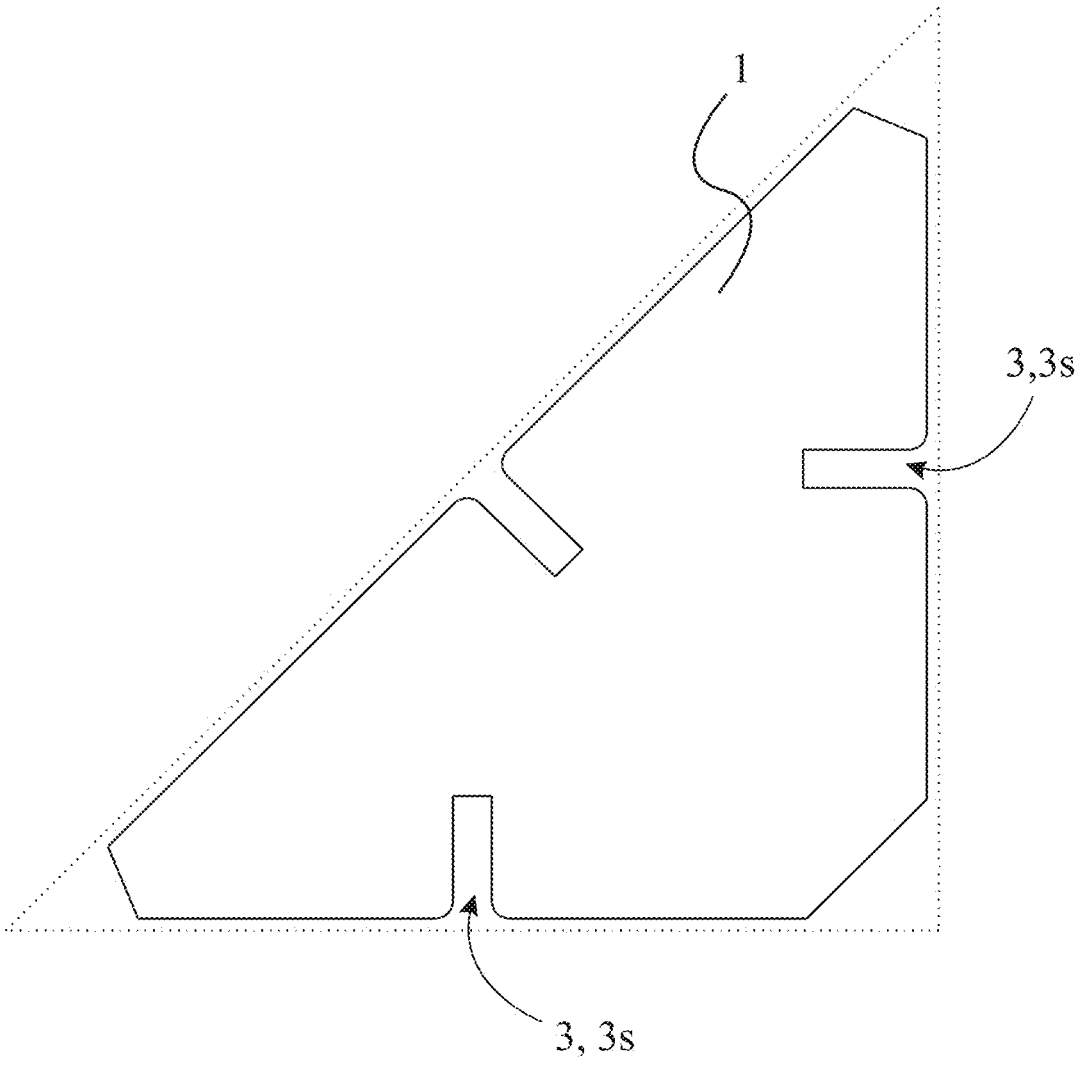
FIG. 3 is a front elevational view of a triangular panel, according to the present invention.

All illustrations of the drawings are for the purpose of describing selected versions of the present invention and are not intended to limit the scope of the present invention.

In reference to FIG. 1 through FIG. 12, the present invention is a building kit. An objective of the present invention is to provide a uniquely designed building kit that can create a variety of structures and shapes. In other words, it is an aim of the present invention to provide a building kit that has improved materials and designs for better qualities. To accomplish this, the present invention comprises panels and connectors, and utility features that help kids to construct and assemble a structure of their choice in various designs. More specifically, structures may be constructed in many creative designs by allowing the panels to be connected vertically, horizontally, and at any angle. Further, the constructed structures can be disassembled and constructed again to build other designs. To that end, the present invention can be disassembled safely by kids to prevent trapping kids in the structure. Additionally, the present invention is simple, durable, and light weight enough for young kids to build different structures of their choice.

The following description is in reference to FIG. 1 through FIG. 12. According to a preferred embodiment, the present invention comprises a plurality of panels 1, at least one connector 2, and a plurality of slots 3. Preferably, the plurality of panels 1 forms the wall for the structure and comes in a variety of geometrical shapes. Further, the plurality of panels 1 is made of a light weight, inexpensive, safe, and recyclable material, such as corrugated cardboard that comes in a variety of geometrical shapes. However, the plurality of panels 1 may comprise any other material that is known to one of ordinary skill in the art, as long as the intents of the present invention are not altered. The at least one connector 2 connects the plurality of panels 1 in various shapes and angles to construct a desired structure. Further, the at least one connector 2 allows the plurality of panels 1 to stack vertically, horizontally, or to connect at any angle to make a corner. Preferably, the connector 2 is circular and is made of a sturdy high density foam material that is compressible. This is because, a circular connector allows panels to be connected at any angle along an axis defined by the edge of the panel. This enables kids to build doors that can swing open and close. More specifically, using a circular connector provides a force to hold together the panels in every direction (even vertically).

Furthermore, the foam connectors help hold the connected panels together in every force direction.

In the preferred embodiment, the plurality of panels 1 has a thickness of 0.2 inches, and the at least one connector 2 has a thickness of 0.4 inches, although any desired dimensions may be used. When in use or when the at least one connector 2 is being part a structure, the at least one connector 2 is positioned normal to the plurality of panels 1.

Figure 10:
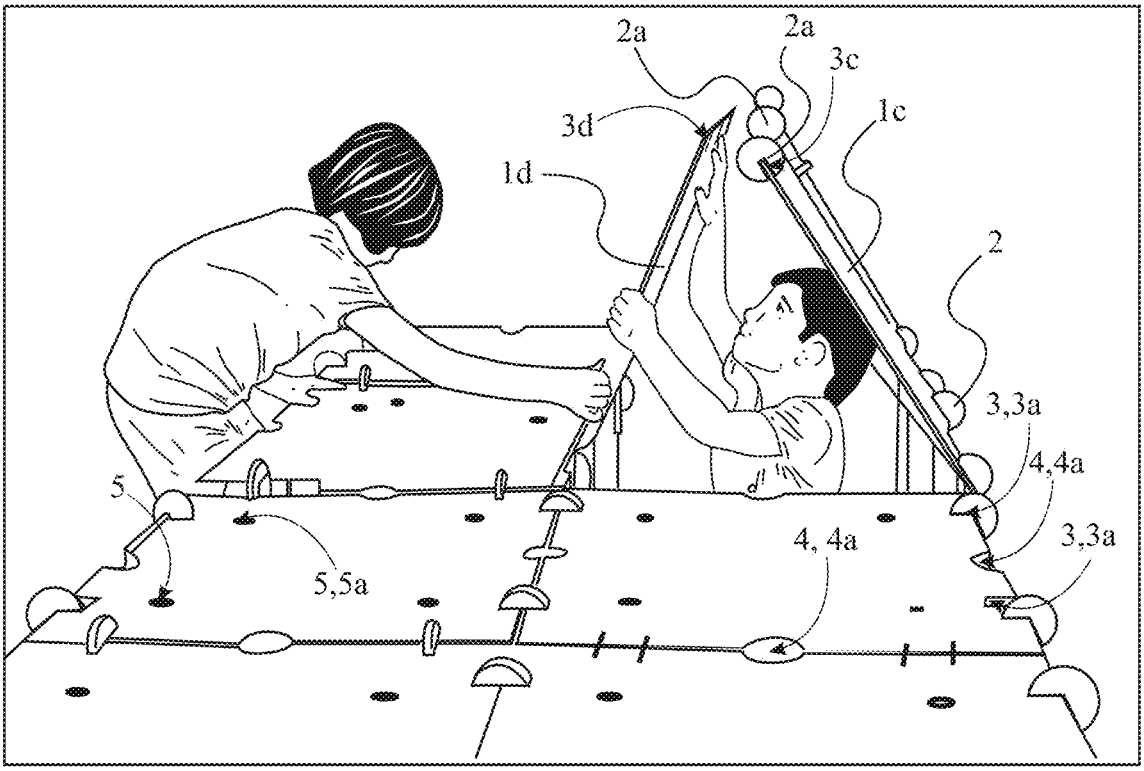
FIG. 10 is a perspective view of the present invention, wherein a structure is in the process of being made.
Figure 11:
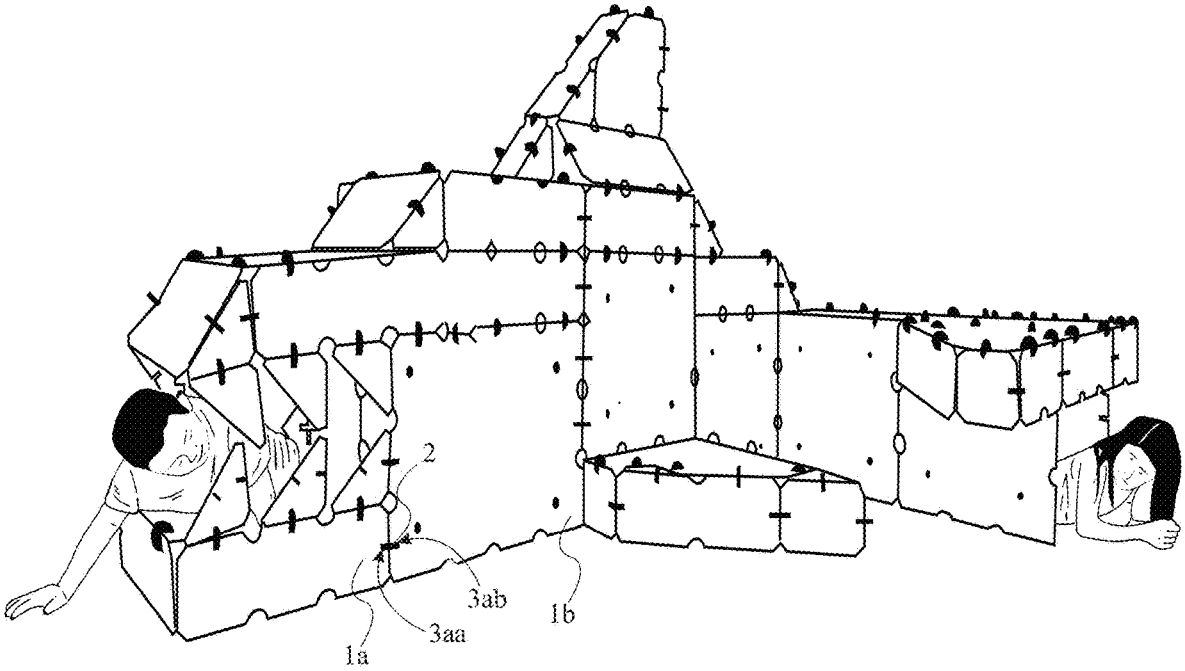
FIG. 11 is a perspective view of a 3D shark structure made with the present invention.
Figure 12:
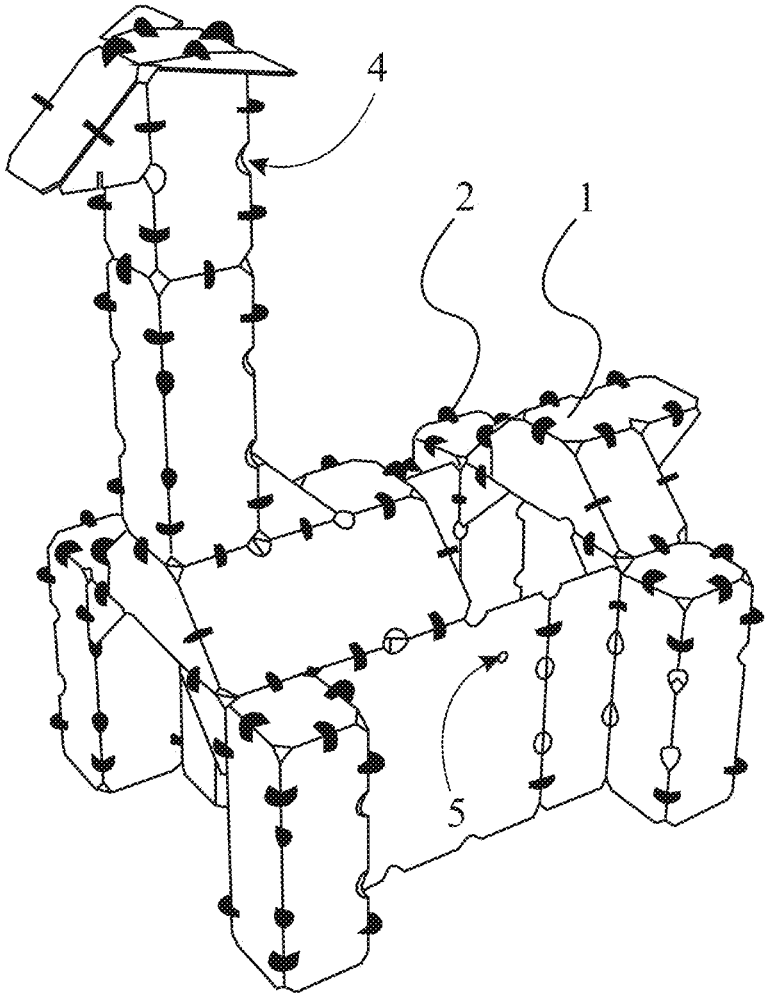
FIG. 12 is a perspective view of a 3D giraffe structure made with the present invention.

As seen in FIG. 1, and FIG. 3 through FIG. 12, an arbitrary plurality of slots 3*a* is perimetrically distributed around each of the plurality of panels 1, wherein the arbitrary plurality of slots 3*a* is from the plurality of slots 3. Further, the arbitrary plurality of slots 3*a* normally traverses through each of the plurality of panels 1. In other words, the plurality of slots 3 are rectangular cavities distributed along each panel edge. The plurality of slots 3 allows for panel-to-panel connection by engaging the connector 2 into the slots 3 of panels that need to be connected to create the desired structure. More specifically, the connector 2 is operatively coupled in between an arbitrary panel 1*a* and an adjacent panel 1*b*, wherein the connector 2 is engaged into a first desired slot 3*aa* from the plurality of slots 3 and a second desired slot 3*ab* from the plurality of slots 3, and wherein the arbitrary panel 1*a* and the adjacent panel 1*b* are from the plurality of panels 1. Preferably, the connector 2 has a thickness slightly larger than the panel 1 and the plurality of slots 3 to provide a snug friction fit when inserted into the panel 1. In the preferred embodiment, the connector 2 has a radius slightly larger than the panel 1 and slot depths to allow a small gap between adjacent panels 1. However, it should be noted that the plurality of slots 3 and the at least one connector 2 may comprise any other size, as long as the intents of the present invention are not altered. As seen in FIG. 10 through FIG. 12, when being part of a structure, the arbitrary panel 1*a* is mounted angularly offset from the adjacent panel by the connector. Furthermore, depending on the shape of the structure, the arbitrary panel 1*a* can be mounted coplanar with the adjacent panel 1*b* by the connector 2 as well.

In order to allow kids to play inside the structure to peek outside, and parents to see inside of the structure to ensure the kids are safe, a plurality of apertures 4 are provided. Preferably, an arbitrary plurality of apertures 4*a* is perimetrically distributed around each of the plurality of panels 1, wherein the arbitrary plurality of apertures 4*a* is from the plurality of apertures 4. As seen in FIG. 3 through FIG. 12, the arbitrary plurality of apertures 4*a* normally traverses through each of the plurality of panels 1. In the preferred embodiment, the plurality of apertures 4 provides a grip on the panel when constructing structures. Additionally, the plurality of apertures 4*a* creates an interesting light effect when inside the structure. In the preferred embodiment, each of the plurality of apertures 4 is semicircular. However, the plurality of apertures 4 may comprise any other shape or dimension, as long as the intents of the present invention are not altered.

According to a preferred embodiment, the present invention comprises a plurality of holes 5. As seen in FIG. 10, an arbitrary plurality of holes 5*a* traverses through each of the plurality of panels 1, wherein the arbitrary plurality of holes 5*a* is from the plurality of holes 5. Further, the arbitrary plurality of holes 5*a* is evenly distributed adjacent to terminal edges of each of the plurality of panels 1. In other words, the arbitrary plurality of holes 5*a* are circular apertures located on the corner portions of the panel 1. Like the plurality of apertures 4, the plurality of holes 5 also allows kids inside the structure to peek outside and parents to see inside the structure to ensure the kids are safe. Further, the plurality of holes 5 creates an interesting light effect and provides additional ventilation inside the structures formed by the present invention.

As seen in FIG. 10 through FIG. 12, the present invention may be used to create a wide variety of shapes and structures. In reference to FIG. 3, wherein the plurality of panels is triangular, a single slot 3*s* is positioned on each side of the triangle, wherein the single slot 3*s* is from the plurality of slots 3. Preferably, the triangular panel is a small connecting piece that helps in the construction of small features as well as corner connections. Further, it is preferred that smaller components comprise $1/3^{rd}$ the dimensions of larger components for effective construction. For example, length of a square panel with three slots is 3 times the length of a square panel with one slot. Similarly, the length of the shorter side of a rectangle is $1/3^{rd}$ the length of a square with 3 slots along the panel's edge.

Figure 4:
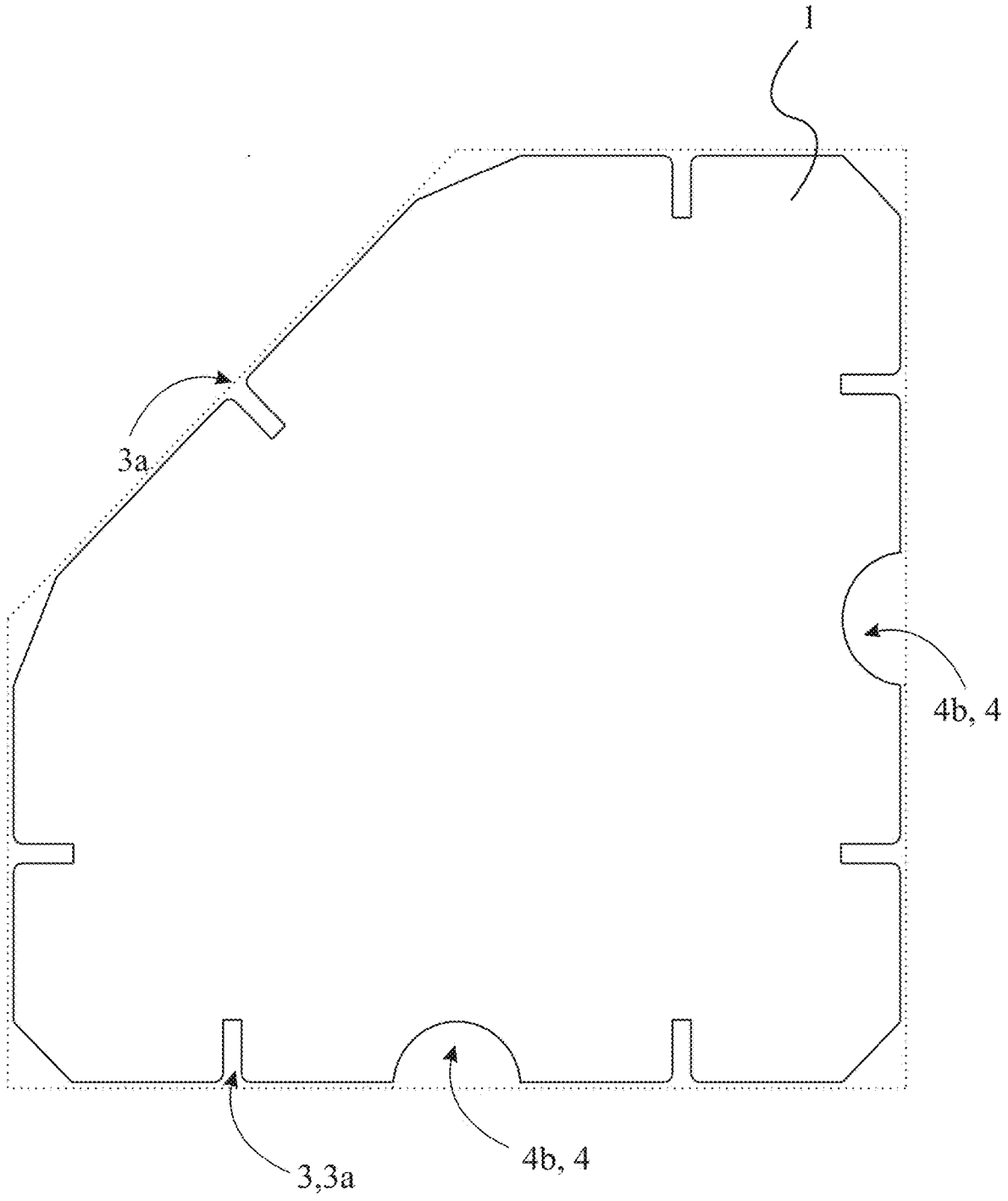
FIG. 4 is a front elevational view of a pentagonal panel, according to the present invention.

In reference to FIG. 4, wherein the plurality of panels is pentagonal, a single aperture 4*b* is positioned along each edge of a plurality of adjacent sides of the pentagon, wherein the single aperture 4*b* is from the plurality of apertures 4. Additionally, the single aperture 4*b* is positioned midway along a length of each of plurality of adjacent sides.

Figure 5:
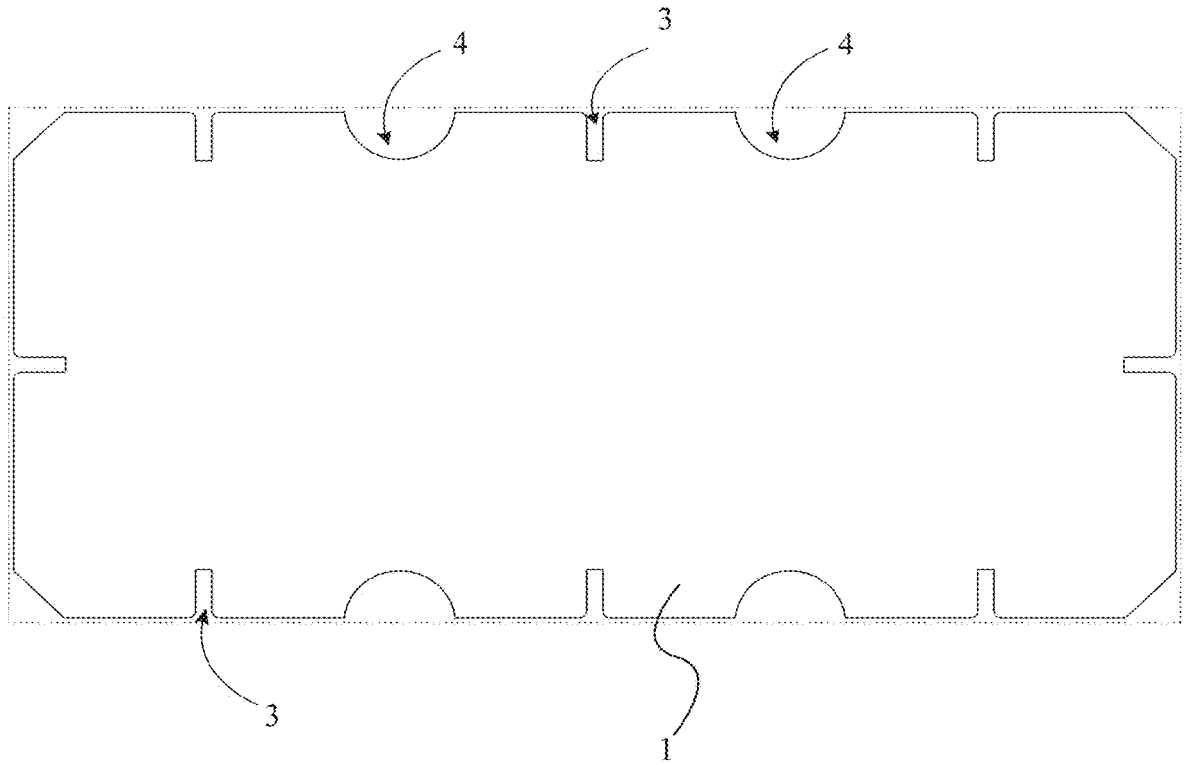
FIG. 5 is a front elevational view of a rectangular panel, according to the present invention.
Figure 6:
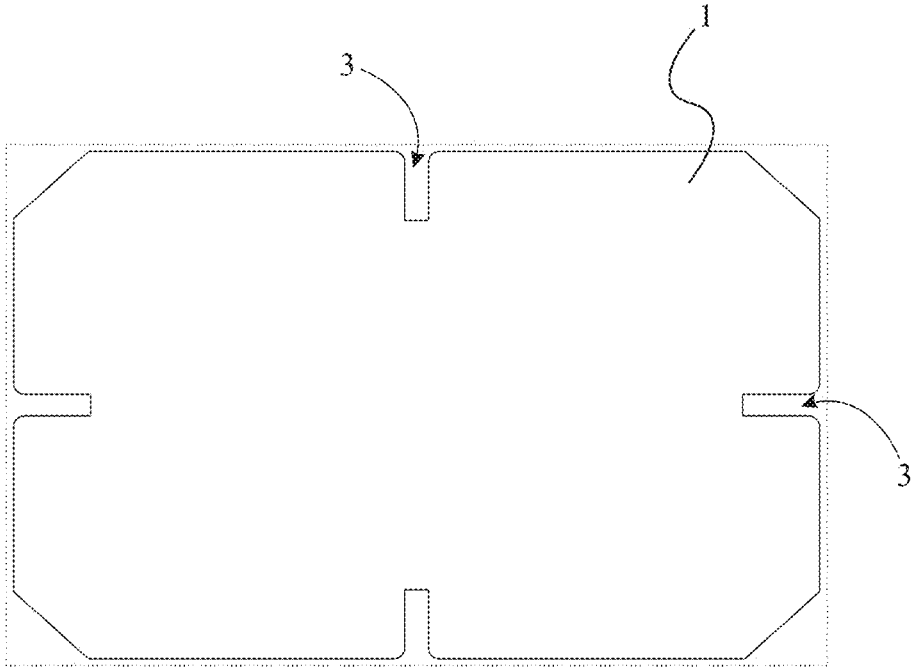
FIG. 6 is a front elevational view of a rectangular panel, according to an alternate embodiment of the present invention.
Figure 7:
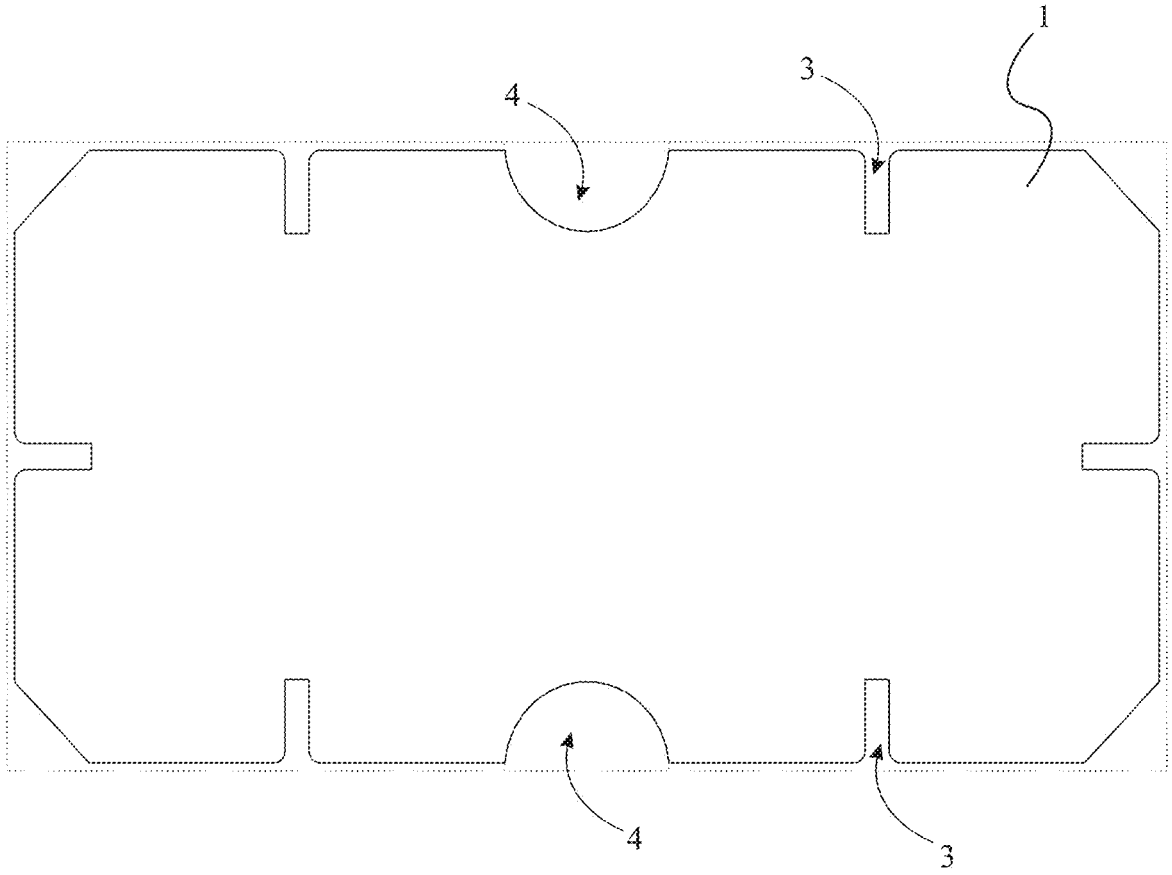
FIG. 7 is a front elevational view of a rectangular panel, according to an alternate embodiment of the present invention.
Figure 8:
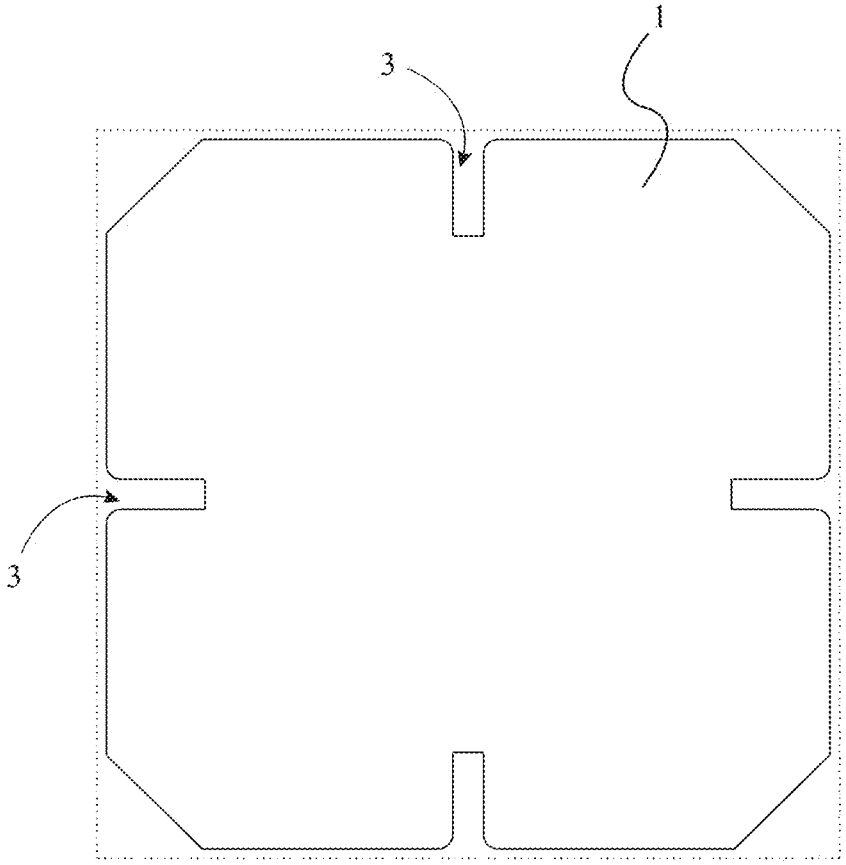
FIG. 8 is a front elevational view of a square panel, according to the present invention.
Figure 9:
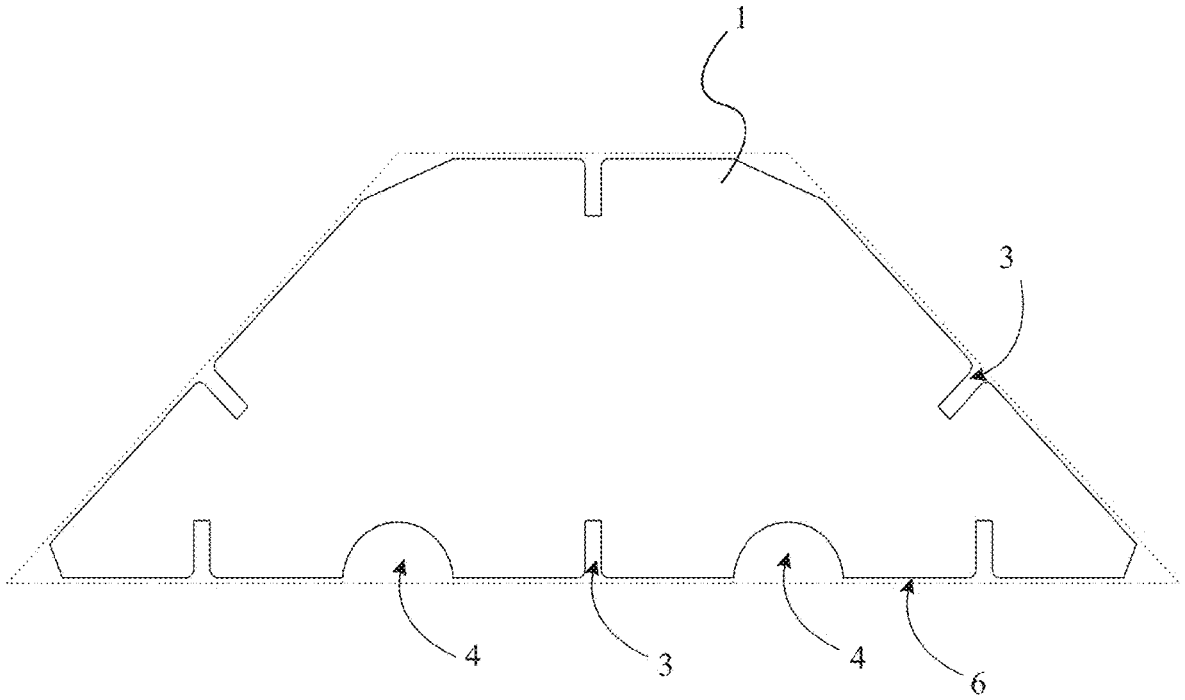
FIG. 9 is a front elevational view of a trapezoidal panel, according to the present invention.

In reference to FIG. 5 through FIG. 7, the plurality of panels 1 is rectangular.

However, each of the rectangular panels comprise different positioning for the plurality of slots 3 and the plurality of apertures 4. In reference to FIG. 8 the panel is a square without any apertures.

In reference to FIG. 10, wherein the plurality of panels 1 is trapezoidal, the plurality of apertures 4 is evenly distributed along a base 6 of the trapezoid. In other words, two semicircular cuts are evenly placed along a bottom end of the trapezoidal panel.

As seen in FIG. 3 through FIG. 9, vertices of each of the plurality of panels 1 are blunted. In other words, corners of the plurality of panels 1 have been made blunt, so that users are not hurt, and surfaces are not damaged by pointy edges of the panels. According to the preferred embodiment, wherein the building kit is in a disassembled state, the plurality of panels 1 is detached from the at least one connector 2. In other words, the built structure may be disassembled and built again for a new design or stored in a storage case. This is because the present invention utilizes friction fit connections that require very low tolerance due to the thickness of the foam connectors and width of slots. This ensures the right friction fit that is adequate for building things but also allows for easy deconstruction. Further, multiple kits may be purchased to build bigger structures. Furthermore, the present invention may comprise a carrying case. Preferably, the carrying case is a bag or a box with a handle in any shape or material that allows a user to store or carry around the present invention.

In order to efficiently assemble the components of the present invention into various structures, the present invention comprises a method. According to the preferred method, assembly of the building kit comprises the following steps. Firstly, a plurality of panels 1 and a plurality of connectors 2 are provided, wherein a plurality of slots 3 normally traverses through perimetrical edges of each of the plurality of panels 1 (Step A). To start the process of building, a first set of connectors 2*a* is inserted into a first set of slots 3*c* of a first panel 1*c* wherein the first set of connectors 2*a* is from the plurality of connectors 2, the first set of slots 3*c* is from the plurality of slots 3 and the first panel 1*c* is from the plurality of panels 1 (Step B). Subsequently, a second panel 1*d* is placed adjacent the first panel 1*c*, wherein a second set of slots 3*d* of the second panel 1*d* is aligned to the first set of slots 3*c*, and wherein the second panel 1*d* is from the plurality of panels 1, and the second set of slots 3*d* is from the plurality of slots 3 (Step C). For example, each edge of the panel creates an option to use all slots for panel-to-panel connections. Utilizing the present invention, the user can build a door which is capable of dynamic movements. The user would place two to four connectors along the edge of a panel that the user wants to use as the door and connecting to one of the structure panels and the friction fit will hold the panels together even while swinging the door panel open and closed. Following placement and alignment of the panels, the first set of connectors 2*a* is engaged into the second set of slots 3*d* thereby connecting the first panel 1*c* to the second panel 1*d* (Step D). Depending on the desired shaped of the structure, the angle between the first panel 1*c* and the second panel 1*d* may be adjusted (Step E). Further, Steps A through E are repeated to integrate each of the plurality of panels and the plurality of connectors into a structure.

Thus, the present invention is a simple and light weight fort building kit, that is engaging, safe and versatile.

Although the invention has been explained in relation to its preferred embodiment, it is to be understood that many other possible modifications and variations can be made without departing from the spirit and scope of the invention.

What is claimed is:

1. A building kit comprising:

a plurality of fort panels;

a plurality of circular connectors;

the plurality of fort panels comprising a plurality of main square-shaped panels, a plurality of ancillary square-shaped panels, a plurality of small-sized rectangular-shaped panels, a plurality of intermediately-sized rectangular-shaped panels, a plurality of large-sized rectangular-shaped panels, a plurality of triangular-shaped panels, and a plurality of pentagonal-shaped panels;

each of the plurality of fort panels comprising a panel body and a plurality of slots;

the plurality of fort panels being a physically separate set of components than the plurality of circular connectors;

the plurality of circular connectors being made of a sturdy high density foam material;

the plurality of slots being perimetrically distributed around the panel body;

each of the plurality of slots laterally traversing into the panel body;

a selected group of fort panels from the plurality of fort panels being arranged into a fort configuration;

an arbitrary panel and an adjacent panel being hingedly attached to each other by at least one corresponding circular connector from the plurality of circular connectors, wherein the at least one corresponding circular connector is attached into at least one first desired slot from the plurality of slots for the arbitrary panel, and wherein the corresponding circular connector is attached into at least one second desired slot from the plurality of slots for the adjacent panel, and wherein the arbitrary panel and the adjacent panel are any panel pair from the selected group of fort panels; and a panel surface area for each of the plurality of main square-shaped panels being larger than a panel surface area for each of the plurality of ancillary square-shaped panels, each of the plurality of small-sized rectangular-shaped panels, each of the plurality of intermediately-sized rectangular-shaped panels, each of the plurality of large-sized rectangular-shaped panels, each of the plurality of triangular-shaped panels, and each of the plurality of pentagonal-shaped panels.

2. The building kit as claimed in claim 1 comprising:

a panel surface area for each of the plurality of main square-shaped panels being dimensionally configured to build larger structures within the fort configuration; and a panel surface area for each of the plurality of ancillary square-shaped panels, each of the plurality of small-sized rectangular-shaped panels, each of the plurality of intermediately-sized rectangular-shaped panels, each of the plurality of large-sized rectangular-shaped panels, each of the plurality of triangular-shaped panels, and each of the plurality of pentagonal-shaped panels being dimensionally configured to build interstitial structures amongst the larger structures within the fort configuration.

3. The building kit as claimed in claim 1 comprising:

the at least one corresponding circular connector being positioned perpendicular to the arbitrary panel and the adjacent panel.

4. The building kit as claimed in claim 1 comprising:

the arbitrary panel being positioned at an acute angle with the adjacent panel.

5. The building kit as claimed in claim 1 comprising:

the arbitrary panel being positioned at an obtuse angle with the adjacent panel.

6. The building kit as claimed in claim 1 comprising:

the arbitrary panel being positioned at a right angle with the adjacent panel.

7. The building kit as claimed in claim 1 comprising:

the arbitrary panel being positioned at a straight angle with the adjacent panel.

8. The building kit as claimed in claim 1 comprising:

each of the plurality of main square-shaped panels, each of the plurality of intermediately-sized rectangular-shaped panels, each of the plurality of large-sized rectangular-shaped panels, and each of the plurality of pentagonal-shaped panels each comprising a plurality of apertures;

the plurality of apertures being perimetrically distributed about the panel body for each of the plurality of plurality of main square-shaped panels, each of the plurality of intermediately-sized rectangular-shaped panels, each of the plurality of large-sized rectangular-shaped panels, and each of the plurality of pentagonal-shaped panels;

each of the plurality of apertures laterally traversing into the panel body for each of the plurality of plurality of main square-shaped panels, each of the plurality of intermediately-sized rectangular-shaped panels, each of the plurality of large-sized rectangular-shaped panels, and each of the plurality of pentagonal-shaped panels; and the plurality of apertures being interspersed amongst the plurality of slots for each of the plurality of plurality of main square-shaped panels, each of the plurality of intermediately-sized rectangular-shaped panels, each of the plurality of large-sized rectangular-shaped panels, and each of the plurality of pentagonal-shaped panels.

9. The building kit as claimed in claim 8, wherein each of the plurality of apertures is a semicircular cutout.

10. The building kit as claimed in claim 1 comprising:

each of plurality of main square-shaped panels comprising a plurality of holes;

the plurality of holes being distributed across the panel body for each of plurality of main square-shaped panels; and each of the plurality of holes traversing normal through the panel body for each of plurality of main square-shaped panels.

11. The building kit as claimed in claim 1 comprising:

the panel body comprising a plurality of polygonal sides;

the plurality of polygonal sides being perimetrically positioned around the panel body;

the plurality of slots being numerically equal to the plurality of polygonal sides for each of the plurality of small-sized rectangular-shaped panels, each of the plurality of ancillary square-shaped panels, each of the plurality of triangular-shaped panels; and each of the plurality of slots being positioned at a midpoint along a corresponding polygonal side from the plurality of polygonal sides for each of the plurality of small-sized rectangular-shaped panels, each of the plurality of ancillary square-shaped panels, and each of the plurality of triangular-shaped panels.

12. The building kit as described in claim 1, wherein a plurality of vertices for the panel body being chamfered.

13. The building kit as described in claim 1, wherein each of the plurality of slots is a rectangular notch.

* * * * *